US008690970B2

(12) United States Patent
Fang

(10) Patent No.: US 8,690,970 B2
(45) **Date of Patent: *Apr. 8, 2014**

(54) FUEL ADDITIVE FOR IMPROVED PERFORMANCE IN FUEL INJECTED ENGINES

(75) Inventor: Xinggao Fang, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 87 days.

This patent is subject to a terminal disclaimer.

(21) Appl. No.: 13/404,829

(22) Filed: Feb. 24, 2012

(65) Prior Publication Data

US 2013/0220255 A1 Aug. 29, 2013

(51) Int. Cl.
*C10L 1/19* (2006.01)
*C07C 69/88* (2006.01)

(52) U.S. Cl.
USPC ..... 44/422; 44/399; 44/400; 44/408; 560/67; 560/71

(58) Field of Classification Search
USPC ..... 44/356, 399, 400, 408, 422
See application file for complete search history.

(56) References Cited

U.S. PATENT DOCUMENTS

| | | | | |
|---|---|---|---|---|
| 3,015,668 | A | 1/1962 | Kozikowski | |
| 3,468,640 | A | 9/1969 | Barusch et al. | |
| 3,778,371 | A | 12/1973 | Malec | |
| 4,056,531 | A | 11/1977 | Malec | |
| 4,171,959 | A | 10/1979 | Vartanian | |
| 4,248,719 | A | 2/1981 | Chafetz et al. | |
| 4,253,980 | A | 3/1981 | Hammond et al. | |
| 4,326,973 | A | 4/1982 | Hammond et al. | |
| 4,338,206 | A | 7/1982 | Hammond et al. | |
| 4,482,357 | A | 11/1984 | Hanlon | |
| 4,787,916 | A | 11/1988 | Feldman | |
| 5,254,138 | A | 10/1993 | Kurek | |
| 5,575,823 | A | 11/1996 | Wallace et al. | |
| 5,688,751 | A | 11/1997 | Cleveland et al. | |
| 5,713,966 | A * | 2/1998 | Cherpeck | 44/400 |
| 5,752,989 | A | 5/1998 | Henly et al. | |
| 7,906,470 | B2 | 3/2011 | Stevenson et al. | |
| 7,947,093 | B2 | 5/2011 | Barton et al. | |
| 7,951,211 | B2 | 5/2011 | Barton et al. | |
| 8,147,569 | B2 * | 4/2012 | Barton et al. | 44/422 |
| 8,153,570 | B2 * | 4/2012 | Barton et al. | 508/547 |
| 2003/0131527 | A1 | 7/2003 | Colucci et al. | |
| 2008/0113890 | A1 | 5/2008 | Moreton et al. | |
| 2010/0236510 | A1 | 9/2010 | Shea et al. | |
| 2011/0315107 | A1 | 12/2011 | Grabarse et al. | |
| 2012/0328293 | A1 | 12/2012 | Grobe et al. | |
| 2013/0031828 | A1 * | 2/2013 | Reid et al. | 44/386 |
| 2013/0118062 | A1 * | 5/2013 | Fang et al. | 44/405 |

FOREIGN PATENT DOCUMENTS

| | | | |
|---|---|---|---|
| EP | 0293192 | B1 | 11/1991 |
| EP | 2033945 | A1 | 3/2009 |
| WO | 2011095819 | A1 | 8/2011 |
| WO | 2011110860 | A1 | 9/2011 |
| WO | 2011141731 | A1 | 11/2011 |
| WO | 2011149799 | A1 | 12/2011 |

* cited by examiner

*Primary Examiner* — Ellen McAvoy
(74) *Attorney, Agent, or Firm* — Luedeka Neely Group, P.C.

(57) ABSTRACT

A fuel composition for a fuel injected internal combustion engine, a method for improving performance of fuel injectors and a method for cleaning fuel injectors for a fuel-injected internal combustion engine. The fuel composition includes a major amount of fuel and a minor, effective amount of a quaternary ammonium salt of a hydrocarbyl amine and a hydrocarbyl-substituted alkyl-hydroxybenzoate. The amount of quaternary ammonium salt present in the fuel is sufficient to improve performance of the fuel injected internal combustion engine having combusted the composition compared to the performance of such engine having combusted a fuel composition that does not contain the quaternary ammonium salt. The hydrocarbyl-substituted alkyl-hydroxybenzoate contains one or more hydrocarbyl substituents providing a total of at least 8 up to about 200 carbon atoms, provided the one or more hydrocarbyl substituents do not contain sulfur, oxygen, or nitrogen atoms.

27 Claims, No Drawings

FUEL ADDITIVE FOR IMPROVED PERFORMANCE IN FUEL INJECTED ENGINES

TECHNICAL FIELD

The disclosure is directed to fuel additives and to additive and additive concentrates that include the additive that are useful for improving the performance of fuel injected internal combustion engines. In particular the disclosure is directed to a fuel additive that is effective to enhance the performance of fuel injectors for diesel and gasoline engines.

BACKGROUND AND SUMMARY

It has long been desired to maximize fuel economy, power and driveability in gasoline and diesel fuel powered vehicles while enhancing acceleration, reducing emissions, and preventing hesitation. While it is known to enhance gasoline powered engine performance by employing dispersants to keep valves and fuel injectors clean in port fuel injection engines, such gasoline dispersants are not necessarily effective direct fuel injected diesel engines. The reasons for this unpredictability lie in the many differences between the direct and indirect fuel injected diesel engines and the fuels suitable for such engines.

For example, there is a dramatic difference between indirect fuel injected diesel engines, and more modern high pressure common rail (HPCR), direct fuel injected diesel engines. Also, low sulfur diesel fuels and ultra low sulfur diesel fuels are now common in the marketplace for such engines. A "low sulfur" diesel fuel means a fuel having a sulfur content of 50 ppm by weight or less based on a total weight of the fuel. An "ultra low sulfur" diesel fuel (ULSD) means a fuel having a sulfur content of 15 ppm by weight or less based on a total weight of the fuel. Fuel injectors in an HPCR engine perform at much higher pressures and temperatures compared to older style engines and fuel injection systems. The combination of low sulfur or ULSD and HPCR engines have resulted in a change to the type of injector deposits and frequency of formation of injector deposits now being found in the marketplace.

Over the years, dispersant compositions for diesel fuels have been developed. Dispersant compositions known in the art for use in fuels include compositions that may include polyalkylene succinimides, polyamines and polyalkyl substituted Mannich compounds. Dispersants are suitable for keeping soot and sludge suspended in a fluid, however dispersants are not particularly effective for cleaning surfaces once deposits have formed on the surfaces.

Fuel compositions for fuel injected engines often produce undesirable deposits in the engines. Accordingly, improved compositions that can prevent deposit build up, maintaining "as new" cleanliness for the vehicle life are desired. Ideally, the same composition that can clean up dirty fuel injectors restoring performance to the previous "as new" condition would be equally desirable and valuable in the attempt to reduce air borne exhaust emissions and to improve the power performance of the engines.

In accordance with the disclosure, exemplary embodiments provide a fuel composition for an internal combustion engine, a method for improving performance of fuel injectors, and a method for cleaning fuel injectors for an internal combustion engine. The fuel composition includes a major amount of fuel and a minor, effective amount of a quaternary ammonium salt of a tertiary hydrocarbyl amine and a hydrocarbyl-substituted alkyl-hydroxybenzoate. The amount of quaternary ammonium salt present in the fuel is sufficient to improve performance of a direct fuel injected diesel engine having combusted the composition, compared to the performance of such engine having combusted a fuel composition that does not contain the quaternary ammonium salt. The hydrocarbyl-substituted alkyl-hydroxybenzoate can in one embodiment contain one or more hydrocarbyl substituents providing a total of at least 8 up to about 200 carbon atoms, provided the one or more hydrocarbyl substituents do not contain sulfur, oxygen, or nitrogen atoms.

Another embodiment of the disclosure provides a method of improving the injector performance of a fuel injected internal combustion engine. The method includes operating the engine on a fuel composition containing a major amount of fuel and from about 5 to about 200 ppm by weight based on a total weight of the fuel of a quaternary ammonium salt of a tertiary hydrocarbyl amine and a hydrocarbyl-substituted alkyl-hydroxybenzoate. The quaternary ammonium salt present in the fuel improves the injector performance of the engine. The hydrocarbyl-substituted alkyl-hydroxybenzoate contains one or more hydrocarbyl substituents providing a total of at least 8 up to about 200 carbon atoms, provided the one or more hydrocarbyl substituents do not contain sulfur, oxygen, or nitrogen atoms.

A further embodiment of the disclosure provides a method of operating a fuel injected internal combustion engine. The method includes combusting in the engine a fuel composition comprising a major amount of fuel and from about 5 to about 200 ppm by weight based on a total weight of the fuel of a quaternary ammonium salt of a tertiary hydrocarbyl amine and a hydrocarbyl-substituted alkyl-hydroxybenzoate. The hydrocarbyl-substituted alkyl-hydroxybenzoate contains one or more hydrocarbyl substituents providing a total of at least 8 up to about 200 carbon atoms, provided the one or more hydrocarbyl substituents do not contain sulfur, oxygen, or nitrogen atoms.

Another embodiment of the disclosure provides an additive concentrate for a fuel for use in a fuel injected internal combustion engine. The additive concentrate includes a quaternary ammonium salt of a tertiary hydrocarbyl amine and a hydrocarbyl-substituted alkyl-hydroxybenzoate and at least one component selected from the group consisting of diluents, compatibilizers, corrosion inhibitors, cold flow improvers (CFPP additive), pour point depressants, solvents, demulsifiers, lubricity additives, friction modifiers, amine stabilizers, combustion improvers, dispersants, antioxidants, heat stabilizers, conductivity improvers, metal deactivators, marker dyes, organic nitrate ignition accelerators, and cyclomatic manganese tricarbonyl compounds. The hydrocarbyl-substituted alkyl-hydroxybenzoate contains one or more hydrocarbyl substituents providing a total of at least 8 up to about 200 carbon atoms, provided the one or more hydrocarbyl substituents do not contain sulfur, oxygen, or nitrogen atoms.

An advantage of the fuel additive described herein is that the additive may not only reduce the amount of deposits forming on fuel injectors, but the additive may also be effective to clean up dirty fuel injectors sufficient to provide improved power recovery to the engine.

Additional embodiments and advantages of the disclosure will be set forth in part in the detailed description which follows, and/or can be learned by practice of the disclosure. It is to be understood that both the foregoing general description and the following detailed description are exemplary and explanatory only and are not restrictive of the disclosure, as claimed.

DETAILED DESCRIPTION OF EXEMPLARY EMBODIMENTS

The fuel additive component of the present application may be used in a minor amount in a major amount of fuel and may be added to the fuel directly or added as a component of an additive concentrate to the fuel. A particularly suitable fuel additive component for improving the operation of internal combustion engines may be made by a wide variety of well known reaction techniques with amines or polyamines. For example, such additive component may be made by reacting a tertiary amine of the formula

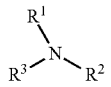

wherein each of $R^1$, $R^2$, and $R^3$ is selected from hydrocarbyl groups containing from 1 to 200 carbon atoms, with a quaternizing agent to provide a compound of the formula:

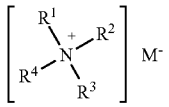

wherein each of $R^1$, $R^2$, $R^3$, and $R^4$ is selected from hydrocarbyl groups containing from 1 to 200 carbon atoms. In one embodiment, at least one and not more than three of $R^1$, $R^2$, $R^3$, and $R^4$ is a hydrocarbyl group containing from 1 to 4 carbon atoms. In another embodiment, at least one of $R^1$, $R^2$, and $R^3$ is a hydrocarbyl group containing from 8 to 200 carbon atoms, and $M^-$ comprises a hydrocarbyl-substituted hydroxybenzoate group.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 wt. %, for example from about 80 to about 98 wt . % relative to the total weight of the composition. Moreover, as used herein, the term "minor amount" is understood to mean an amount less than 50 wt. % relative to the total weight of the composition.

Methods for making quaternary ammonium salts include but are not limited to by ion exchange reactions, or by direct alkylation of a tertiary amine or polyamine. Direct alkylation may include methylation of tertiary amines such as pyridine and isoquinoline with methyl carboxylates, or alkylation of a tertiary amine with a hydrocarbyl epoxide in a one or two step reaction.

Amine Compound

In one embodiment, a tertiary amine including monoamines and polyamines may be reacted with the hydroxybenzoate compound. Suitable tertiary amine compounds of the formula

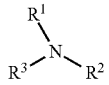

wherein each of $R^1$, $R^2$, and $R^3$ is selected from hydrocarbyl groups containing from 1 to 200 carbon atoms. Each hydrocarbyl group $R^1$ to $R^3$ may independently be linear, branched, substituted, cyclic, saturated, unsaturated, or contain one or more hetero atoms. Suitable hydrocarbyl groups may include, but are not limited to alkyl groups, aryl groups, alkylaryl groups, arylalkyl groups, alkoxy groups, aryloxy groups, and the like. Particularly suitable hydrocarbyl groups may be linear or branched alkyl groups. Some representative examples of amine reactants which can be quaternarized to yield compounds of this invention are: trimethyl amine, triethyl amine, tri-n-propyl amine, dimethylethyl amine, dimethyl lauryl amine, dimethyl oleyl amine, dimethyl stearyl amine, dimethyl eicosyl amine, dimethyl octadecyl amine, N-methyl piperidine, N,N'-dimethyl piperazine, N-methyl-N'-ethyl piperazine, N-methyl morpholine, N-ethyl morpholine, N-hydroxyethyl morpholine, pyridine, triethanol amine, triisopropanol amine, methyl diethanol amine, dimethyl ethanol amine, lauryl diisopropanol amine, stearyl diethanol amine, dioleyl ethanol amine, dimethyl isobutanol amine, methyl diisooctanol amine, dimethyl propenyl amine, dimethyl butenyl amine, dimethyl octenyl amine, ethyl didodecenyl amine, dibutyl eicosenyl amine, triethylene diamine, hexamethylene tetramine, N,N,N',N'-tetramethylethylenediamine, N,N,N',N'-tetramethylpropylenediamine, N,N,N',N'-tetraethyl-1,3-propanediamine, methyldicyclohexyl amine, 2,6-dimethylpyridine, dimethylcylohexylamine, polyolefin amines such as polyisobutenylamines, and the like.

Other representative examples of useful tertiary amines include, but are not limited to, acylated polyamines, alkoxylated fatty tertiary amines, fatty acid substituted tertiary amines, and polyether tertiary amines. Examples include, but are not limited to, $C_8$-$C_{22}$-alkyl or alkenyl-substituted amidopropyldimethylamine, cocoamidopropyldimethylamine, oleylamindopropyldimentylamine, dimethylaminoethanol, 1-dimethylamino-2-propanol, $C_0$-$C_{22}$-alkyl or alkenyl-substituted succinic-imidopropyldimethylamine, polyisobutenyl succinimide polyamine, and the like. When a polyolefinic amine or alkenyl-substituted amido or imido amine is used, the number average molecular weight of the polyolefinic or alkenyl group may range from about 500 to about 1500 or more, such as from about 900 to about 1200 as determined by GPC.

If the amine contains solely primary or secondary amino groups, it is necessary to alkylate at least one of the primary or secondary amino groups to a tertiary amino group prior to quaternizing the amine. In one embodiment, alkylation of primary amines and secondary amines or mixtures with tertiary amines may be exhaustively or partially alkylated to a tertiary amine and further alkylated to a quaternary salt all in one step. If a one step reaction is used, it may be necessary to properly account for the hydrogens on the nitrogens and provide base or acid as required (e.g., alkylation up to the tertiary amine requires removal (neutralization) of the hydrogen (proton) from the product of the alkylation). If alkylating agents, such as, alkyl halides or dialkyl sulfates are used, the product of alkylation of a primary or secondary amine is a protonated salt and needs a source of base to free the amine and to proceed to the quaternary salt. Such alkylating agents require alkylation of the tertiary amine, and the product is the quaternary ammonium halide or monomethyl sulfate. By contrast, epoxides as alkylating agents do both the alkylation and the neutralization such that the intermediate alkylation product is already the free amine. To proceed to the quaternary salt with epoxides it is necessary to provide an equivalent of an acid to provide a proton for the hydroxy group and a counter anion for the salt.

Hydrocarbyl-substituted Alkyl-hydroxybenzoate

The quaternizing agent suitable for converting the tertiary amine to a quaternary nitrogen compound may be a compound of the formula:

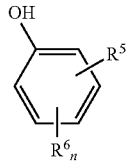

wherein $R^5$ is a carbonyl group and each of $R^6$ is a hydrocarbyl group, and n is a number from 1 to 3, wherein the total carbon atoms of all of the $R^6$ groups is at least 8 up to about 200 and $R^6$ does not contain N, S or O atoms. In one embodiment, the hydrocarbyl-substituted alkyl-hydroxylbenzoate compound is a compound of the formula:

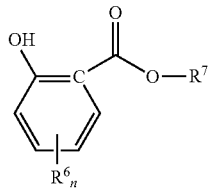

wherein $R^6$ is defined above and $R^7$ is an alkyl group containing from 1 to 4 carbon atoms. In a particularly suitable embodiment, the hydroxybenzoate compound is a methyl ester of the alkyl-substituted hydroxybenzoate. In one embodiment, $R^6$ is a polyolefinic group containing from 20 to 200 carbon atoms. In another embodiment, $R^6$ is a polyisobutenyl group having a number average molecular weight of from about 350 to about 1500. In other embodiments, each of $R^6$ is an alkyl group containing from 4 to 25 carbon atoms. In another embodiment, n is 1 or 2 or 3 or a mixture of compounds where n is 1, 2 and/or 3.

The quaternary ammonium salts may be made in one stage by heating the tertiary amine with the hydrocarbyl-substituted alkyl-hydroxybenzoate compound at an elevated temperature. When the reaction is completed volatile components may be removed by heating the reaction product under vacuum. The product may be diluted with mineral oil, diesel fuel, kerosene, or an inert hydrocarbon solvent if desirable.

In some aspects of the present application, the quaternary ammonium salt compositions of this disclosure may be used in combination with a fuel soluble carrier. Such carriers may be of various types, such as liquids or solids, e.g., waxes. Examples of liquid carriers include, but are not limited to, mineral oil and oxygenates, such as liquid polyalkoxylated ethers (also known as polyalkylene glycols or polyalkylene ethers), liquid polyalkoxylated phenols, liquid polyalkoxylated esters, liquid polyalkoxylated amines, and mixtures thereof. Examples of the oxygenate carriers may be found in U.S. Pat. No. 5,752,989, issued May 19, 1998 to Henly et. al., the description of which carriers is herein incorporated by reference in its entirety. Additional examples of oxygenate carriers include alkyl-substituted aryl polyalkoxylates described in U.S. Patent Publication No. 2003/0131527, published Jul. 17, 2003 to Colucci et. al., the description of which is herein incorporated by reference in its entirety.

In other aspects, the quaternary ammonium salt compositions may not contain a carrier. For example, some compositions of the present disclosure may not contain mineral oil or oxygenates, such as those oxygenates described above.

One or more additional optional compounds may be present in the fuel compositions of the disclosed embodiments. For example, the fuels may contain conventional quantities of cetane improvers, octane improvers, corrosion inhibitors, cold flow improvers (CFPP additive), pour point depressants, solvents, demulsifiers, lubricity additives, friction modifiers, amine stabilizers, combustion improvers, dispersants, detergents, surfactants, antioxidants, heat stabilizers, conductivity improvers, metal deactivators, marker dyes, organic nitrate ignition accelerators, cyclomatic manganese tricarbonyl compounds, and the like. In some aspects, the compositions described herein may contain about 10 weight percent or less, or in other aspects, about 5 weight percent or less, based on the total weight of the additive concentrate, of one or more of the above additives. Similarly, the fuels may contain suitable amounts of conventional fuel blending components such as methanol, ethanol, dialkyl ethers, and the like.

In some aspects of the disclosed embodiments, organic nitrate ignition accelerators that include aliphatic or cycloaliphatic nitrates in which the aliphatic or cycloaliphatic group is saturated, and that contain up to about 12 carbons may be used. Examples of organic nitrate ignition accelerators that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, and the like. Mixtures of such materials may also be used.

Examples of suitable optional metal deactivators useful in the compositions of the present application are disclosed in U.S. Pat. No. 4,482,357 issued Nov. 13, 1984, the disclosure of which is herein incorporated by reference in its entirety. Such metal deactivators include, for example, salicylidene-o-aminophenol, disalicylidene ethylenediamine, disalicylidene propylenediamine, and N,N'-disalicylidene-1,2-diaminopropane.

Suitable optional cyclomatic manganese tricarbonyl compounds which may be employed in the compositions of the present application include, for example, cyclopentadienyl manganese tricarbonyl, methylcyclopentadienyl manganese tricarbonyl, indenyl manganese tricarbonyl, and ethylcyclopentadienyl manganese tricarbonyl. Yet other examples of suitable cyclomatic manganese tricarbonyl compounds are disclosed in U.S. Pat. No. 5,575,823, issued Nov. 19, 1996, and U.S. Pat. No. 3,015,668, issued Jan. 2, 1962, both of which disclosures are herein incorporated by reference in their entirety.

When formulating the fuel compositions of this application, the additives may be employed in amounts sufficient to reduce or inhibit deposit formation in a fuel system or combustion chamber of an engine and/or crankcase. In some aspects, the fuels may contain minor amounts of the above described reaction product that controls or reduces the formation of engine deposits, for example injector deposits in internal combustion engines. For example, the fuels of this application may contain, on an active ingredient basis, an amount of the quaternary ammonium salt in the range of about 5 mg to about 200 mg of reaction product per Kg of fuel, such as in the range of about 1.0 mg to about 150 mg of per Kg of fuel or in the range of from about 30 mg to about 100 mg of the quaternary ammonium salt per Kg of fuel. In aspects, where a carrier is employed, the fuel compositions may contain, on an active ingredients basis, an amount of the carrier in the range of about 1 mg to about 100 mg of carrier per Kg of fuel, such as about 5 mg to about 50 mg of carrier per Kg of fuel. The active ingredient basis excludes the weight of (i) unreacted components associated with and remaining in the product as produced and used, and (ii) solvent(s), if any, used in the manufacture of the product either during or after its formation but before addition of a carrier, if a carrier is employed.

The additives of the present application, including the reaction product described above, and optional additives used in formulating the fuels of this invention may be blended into the base fuel individually or in various sub-combinations. In some embodiments, the additive components of the present application may be blended into the fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

The fuels of the present application may be applicable to the operation of gasoline or diesel engines. The engine include both stationary engines (e.g., engines used in electrical power generation installations, in pumping stations, etc.) and ambulatory engines (e.g., engines used as prime movers in automobiles, trucks, road-grading equipment, military vehicles, etc.). For example, the fuels may include any and all gasoline and middle distillate fuels, diesel fuels, biorenewable fuels, biodiesel fuel, gas-to-liquid (GTL) fuels, jet fuel, alcohols, ethers, kerosene, low sulfur fuels, synthetic fuels, such as Fischer-Tropsch fuels, liquid petroleum gas, bunker oils, coal to liquid (CTL) fuels, biomass to liquid (BTL) fuels, high asphaltene fuels, fuels derived from coal (natural, cleaned, and petcoke), genetically engineered biofuels and crops and extracts therefrom, and natural gas. "Biorenewable fuels" as used herein is understood to mean any fuel which is derived from resources other than petroleum. Such resources include, but are not limited to, corn, maize, soybeans and other crops; grasses, such as switchgrass, miscanthus, and hybrid grasses; algae, seaweed, vegetable oils; natural fats; and mixtures thereof. In an aspect, the biorenewable fuel can comprise monohydroxy alcohols, such as those comprising from 1 to about 5 carbon atoms. Non-limiting examples of suitable monohydroxy alcohols include methanol, ethanol, propanol, n-butanol, isobutanol, t-butyl alcohol, amyl alcohol, and isoamyl alcohol.

Accordingly, aspects of the present application are directed to methods for reducing the amount of injector deposits of engines having at least one combustion chamber and one or more fuel injectors in fluid connection with the combustion chamber. In another aspect, the quaternary ammonium salts described herein may be combined with other quaternary ammonium salts including high molecular weight quaternary ammonium salts having one or more polyolefin groups; such as quaternary ammonium salts of polymono-olefins, polyhydrocarbyl succinimides; polyhydrocarbyl Mannich compounds: polyhydrocarbyl amides and esters, wherein "relatively high molecular weight" means having a number average molecular weight of greater than 600 Daltons. The foregoing quaternary ammonium salts may be disclosed for example in U.S. Pat. Nos. 3,468,640; 3,778,371; 4,056,531; 4171,959; 4,253,980; 4,326,973; 4,338,206; 4,787,916; 5,254,138: 7,906,470; 7,947,093; 7,951,211; U.S. Publication No. 2008/0113890; European Patent application Nos. EP 0293192; EP 2033945; and PCT Application No. WO 2001/110860.

In some aspects, the methods comprise injecting a hydrocarbon-base fuel comprising the quaternary ammonium salt of the present disclosure through the injectors of the engine into the combustion chamber, and igniting the fuel. In some aspects, the method may also comprise mixing into the fuel at least one of the optional additional ingredients described above.

In one embodiment, the fuels of the present application may be essentially free, such as devoid, of conventional succinimide dispersant compounds. In another embodiment, the fuel is essentially free of a quaternary ammonium salt of a hydrocarbyl Mannich compound having a number average molecular weight of greater than 600 Daltons. The term "essentially free" is defined for purposes of this application to be concentrations having substantially no measurable effect on injector cleanliness or deposit formation.

EXAMPLES

The following examples are illustrative of exemplary embodiments of the disclosure. All synthesis was conducted under a nitrogen atmosphere unless indicated otherwise. In these examples as well as elsewhere in this application, all parts and percentages are by weight unless otherwise indicated. It is intended that these examples are being presented for the purpose of illustration only and are not intended to limit the scope of the invention disclosed herein.

Comparative Example 1

Conventional Polyisobutylene-succinimide (PIBSI)

An additive was produced from the reaction of a 950 number average molecular weight polyisobutylene succinic anhydride (PIBSA) with tetraethylenepentamine (TEPA) in a molar ratio of PIBSA/TEPA=1/1. A modified procedure of U.S. Pat. No. 5,752,989 was used. PIBSA (551 g) was diluted in 200 grams of aromatic 150 solvent under nitrogen atmosphere. The mixture was heated to 115° C. TEPA was then added through an addition funnel. The addition funnel was rinsed with additional 50 grams of aromatic 150 solvent. The mixture was heated to 180° C. for about 2 hours under a slow nitrogen sweep. Water was collected in a Dean-Stark trap. The product obtained was a brownish oil.

Comparative Example 2

Dimethyl soy amine (DMSD) with Methyl Salicylate (MS)

A mixture of dimethyl soy amine (DMSD, 74 g) and methyl salicylate (MS, 34.2 g) was heated at 140° C. for 2 hours followed by heating to 155° C. for 3 hours under a nitrogen atmosphere. The resulting liquid turned into a waxy solid (95 g). The FTIR spectrum showed a strong salt peak at 1590 $cm^{-1}$ while the methyl salicylate peak at 1679 $cm^{-1}$ was barely noticeable. The product was not soluble in hydrocarbons including number 2 diesel fuel and aromatic solvent 150.

Inventive Example 3

Dimethyl Soy Amine (DMSD) with $C_{14}$-Methyl Salicylate (MS14)

A. Preparation of Alkylated Methyl Salicylate. To a flask was added solid acid resin (28 g), 1-tetradecene (262 g), and methyl salicylate (102 g). The mixture was heated at 130° C. for 2.5 hours followed by 135° C. for about 10 hours. The mixture was filtered. Unreacted methyl salicylate was removed from the mixture under reduced pressure. The alkylated product (MS14) was obtained as a yellowish liquid (262 g).

B. Quaternization of DMSD with MS14. A mixture of DMSD (100 g) and MS14 (90 g, about 0.6 equivalent) was heated at 160° C. for about 5 hours to give mixture as a brownish oily liquid. The mixture was used without further purification.

Comparative Example 4

Oleylamido Propyldimethylamine (OD) with Methyl Salicylate (MS)

Oleylamidopropyl dimethylamine (OD) was made by heating oleic acid with dimethylamino propylamine and removing water. A mixture of oleylamidopropyl dimethylamine (130 g) and methyl salicylate (49 g) was heated at 155° C. for 2 hours to give product as a brownish oil, which turned into a yellow solid (170 g). The product was not soluble in heptanes or number 2 diesel fuel.

Inventive Example 5

Oleylamido Propyldimethylamine with $C_{14}$-Meth 1 Salicylate MS14

A mixture of oleylamidopropyl dimethylamine (OD, 85 g) made according to Example 4 and $C_{14}$-Methyl Salicylate (MS 14, 103 g) made according to Part A of Example 3 was heated at 160° C. for 4 hours to give a quaternary ammonium reaction product without further purification. There was about 90% wt. of nonvolatile materials in the reaction product.

Comparative Example 6

Oleylamido Propyldimethylamine Dimer (U2D) with Methyl Salicylate (MS)

Oleylamidopropyl dimethylamine dimer (U2D) was made by heating a dimer acid with dimethylamino propylamine and removing water. A mixture of U2D (100 g) and methyl salicylate (39 g) was heated at 150° C. for about 2 hours then at 160° C. for 1 hour. The resulting product was cooled to room temperature and became a solid which was not soluble in number 2 diesel fuel or aromatic solvent 150.

Inventive Example 7

Dimethyl ethanolamine (DMEA) with $C_{10}$-Methyl Salicylate MS10

A mixture dimethyl ethanolamine (DMEA, 20 g) and decyl substituted methyl salicylate (MS10, 97 g) (prepared similarly to inventive Example 3, part A, except 1-decene was used in place of 1-tetradecene) was heated at 145° C. for 2 hours and then at 150° C. for 1 hour. The product was soluble in aromatic solvent 150.

Diesel Engine Test protocol

A DW10 test that was developed by Coordinating European Council (CEC) was used to demonstrate the propensity of fuels to provoke fuel injector fouling and was also used to demonstrate the ability of certain fuel additives to prevent or control these deposits. Additive evaluations used the protocol of CEC F-98-08 for direct injection, common rail diesel engine nozzle coking tests. An engine dynamometer test stand was used for the installation of the Peugeot DW10 diesel engine for running the injector coking tests. The engine was a 2.0 liter engine having four cylinders. Each combustion chamber had four valves and the fuel injectors were DI piezo injectors have a Euro V classification.

The core protocol procedure consisted of running the engine through a cycle for 8-hours and allowing the engine to soak (engine off) for a prescribed amount of time. The foregoing sequence was repeated four times. At the end of each hour, a power measurement was taken of the engine while the engine was operating at rated conditions. The injector fouling propensity of the fuel was characterized by a difference in observed rated power between the beginning and the end of the test cycle.

Test preparation involved flushing the previous test's fuel from the engine prior to removing the injectors. The test injectors were inspected, cleaned, and reinstalled in the engine. If new injectors were selected, the new injectors were put through a 16-hour break-in cycle. Next, the engine was started using the desired test cycle program. Once the engine was warmed up, power was measured at 4000 RPM and full load to check for full power restoration after cleaning the injectors. If the power measurements were within specification, the test cycle was initiated. The following Table 1 provides a representation of the DW10 coking cycle that was used to evaluate the fuel additives according to the disclosure.

TABLE 1

One hour representation of DW10 coking cycle.

| Step | Duration (minutes) | Engine speed (rpm) | Load (%) | Torque (Nm) | Boost air after Intercooler (° C.) |
|---|---|---|---|---|---|
| 1 | 2 | 1750 | 20 | 62 | 45 |
| 2 | 7 | 3000 | 60 | 173 | 50 |
| 3 | 2 | 1750 | 20 | 62 | 45 |
| 4 | 7 | 3500 | 80 | 212 | 50 |
| 5 | 2 | 1750 | 20 | 62 | 45 |
| 6 | 10 | 4000 | 100 | * | 50 |
| 7 | 2 | 1250 | 10 | 25 | 43 |
| 8 | 7 | 3000 | 100 | * | 50 |
| 9 | 2 | 1250 | 10 | 25 | 43 |
| 10 | 10 | 2000 | 100 | * | 50 |
| 11 | 2 | 1250 | 10 | 25 | 43 |
| 12 | 7 | 4000 | 100 | * | 50 |

Various fuel additives were tested using the foregoing engine test procedure in an ultra low sulfur diesel fuel containing zinc neodecanoate, 2-ethylhexyl nitrate, and a fatty acid ester friction modifier (base fuel). A "dirty-up" phase consisting of base fuel only with no additive was initiated, followed by a "clean-up" phase consisting of base fuel with additive. All runs were made with 8 hour dirty-up and 8 hour clean-up unless indicated otherwise. The percent power recovery was calculated using the power measurement at end of the "dirty-up" phase and the power measurement at end of the "clean-up" phase. The percent power recovery was determined by the following formula $$\text{Percent Power recovery}=(DU-CU)/DU\times 100$$

wherein DU is a percent power loss at the end of a dirty-up phase without the additive, CU is the percent power at the end of a clean-up phase with the fuel additive, and power is measured according to CEC F98-08 DW 10 test.

TABLE 2

| Run No. | Additives and treat rate (ppm by weight) | Power loss % DU | CU | Power recovery % (DU − CU)/DU | Ratio Power Recovery % per treat rate |
|---|---|---|---|---|---|
| 1 | Compound of Comparative Example 1 (180 ppmw) | −4.74 | −4.46 | 6 | 0.033 |
| 2 | Compound of Inventive Example 3 (75 ppmw) | −5.5 | 0.14 | 103 | 1.373 |
| 3 | Compound of Inventive Example 5 (75 ppmw) | −4.52 | 1.25 | 128 | 1.707 |

As shown by the foregoing Inventive Examples 3 and 5, the power recovery is substantially greater for the Inventive Examples than for the Comparative Example 1. On a weight basis, the ratio of power recovery per treat rate for the Inventive examples is more than 40 times better than the Comparative Example 1 for providing an increase in Power Recovery %.

For comparison purposes, the percent flow remaining for the compositions tested was also determined in the XUD9 engine test as shown in Table 3. The XUD9 test method is designed to evaluate the, capability of a fuel to control the formation of deposits on the injector nozzles of an Indirect Injection diesel engine. Results of tests run according to the XUD9 test method are expressed in terms of the percentage airflow loss at various injector needle lift points. Airflow measurements are accomplished with an airflow rig complying with ISO 4010.

Prior to conducting the test, the injector nozzles are cleaned and checked for airflow at 0.05, 0.1, 0.2, 0.3 and 0.4 mm lift. Nozzles are discarded if the airflow is outside of the range 250 ml/min to 320 ml/min at 0.1 mm lift. The nozzles are assembled into the injector bodies and the opening pressures set to 115±5 bar. A slave set of injectors is also fitted to the engine. The previous test fuel is drained from the system. The engine is run for 25 minutes in order to flush through the fuel system. During this time all the spill-off fuel is discarded and not returned. The engine is then set to test speed and load and all specified parameters checked and adjusted to the test specification. The slave injectors are then replaced with the test units. Air flow is measured before and after the test. An average of 4 injector flows at 0.1 mm lift is used to calculate the percent of fouling. The degree of flow remaining=100−percent of fouling. The results are shown in the following table.

TABLE 3

| Run No. | Additives and treat rate (ppm by weight) | 0.1 mm lift flow remaining % | Ratio % flow remaining to treat rate |
|---|---|---|---|
| 1 | Compound of Comparative Example 1 (50 ppmw) | 46 | 0.92 |
| 2 | Compound of Inventive Example 3 (25 ppmw) | 86 | 3.44 |

As shown by the foregoing Runs, Run 2 containing the quaternary ammonium salt of the disclosed embodiments was superior to the conventional dispersant even when used at one half the treat rate. In fact, the Inventive Example 3 provided a ratio of flow remaining % per treat rate of greater than 3 times the ratio provided by Comparative Example 1.

Port Fuel Injectors (PFI) Bench Test Protocol ASTM D6421 Modified

The following test method is a bench test procedure that was used to evaluate the tendency of automotive spark-ignition engine fuels to foul electronic port fuel injectors (PFI) in a spark ignition engine. The test method used a bench apparatus equipped with Bosch injectors specified for use in a 1985-1987 Chrysler 2.2-L turbocharged engine. The test method was based on a test procedure developed by the Coordinating Research Council (CRC Report No. 592) for predicting the tendency of spark-ignition engine fuel to form deposits in small metering clearances of fuel injectors in a port fuel injection engine. Fuel injector fouling was calculated according to the following equation:

$$F_o = \frac{F_1 - F_2}{F_1} \times 100$$

where $F_o$ is the percent fouling, $F_1$ is an initial flow mass in tenths of a gram, and $F_2$ is a flow mass at the end of the test in tenths of a gram. The percent fouling was calculated for each injector for three flow mass readings and the average of four injectors was reported in percent.

TABLE 4

| Run No. | Additives and treat rate (ppm by weight) | Average % Fouling ($F_o$) |
|---|---|---|
| 1 | Base Fuel | 42.53 |
| 2 | Base Fuel Plus Conventional Mannich Detergent (200 ppmw) | 19.7 |
| 3 | Base Fuel Plus Compound of Inventive Example 3 (75 ppmw) | 6.21 |

As shown by the foregoing table, a fuel containing the compound of Inventive Example 3 provided significant improvement in injector fouling in a port fuel injected gasoline engine as compared to the base fuel without any detergent and as compared to the same base fuel containing a conventional Mannich detergent even at a lower treat rate of the Inventive compound.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A fuel composition for a fuel injected internal combustion engine comprising: a major amount of fuel and a minor, effective amount of a quaternary ammonium salt from the reaction of a tertiary amine and a hydrocarbyl-substituted alkyl-hydroxybenzoate of the formula

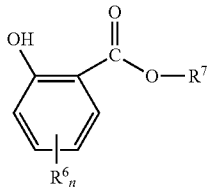

wherein $R^6$ is a hydrocarbyl group, and n is a number from 1 to 3, wherein the total carbon atoms of all of the $R^6$ groups is at least 8 up to about 200 and $R^6$ does not contain N, S or O atoms, and $R^7$ is an alkyl group containing from 1 to 4 carbon atoms, wherein the amount of quaternary ammonium salt present in the fuel is sufficient to improve performance of the fuel injected internal combustion engine having combusted said composition compared to the performance of said engine having combusted a fuel composition that does not contain said quaternary ammonium salt, and wherein the hydrocarbyl-substituted alkyl-hydroxybenzoate contains one or more hydrocarbyl substituents providing a total of at least 8 up to about 200 carbon atoms, provided the one or more hydrocarbyl substituents do not contain sulfur, oxygen, or nitrogen atoms.

2. The fuel composition of claim 1, wherein the fuel has a sulfur content of 50 ppm by weight or less, and wherein the fuel is selected from gasoline and diesel fuels.

3. The fuel composition of claim 1, wherein the quaternary ammonium salt comprises a compound of the formula

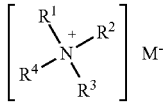

wherein each of $R^1$, $R^2$, $R^3$, and $R^4$ is selected from a hydrocarbyl group containing from 1 to 200 carbon atoms, and $M^-$ comprises a hydrocarbyl-substituted hydroxybenzoate group derived from the hydrocarbyl-substituted alkyl-hydroxybenzoate.

4. The fuel composition of claim 3, wherein at least one and not more than three of $R^1$, $R^2$, $R^3$, and $R^4$ is a hydrocarbyl group containing from 1 to 4 carbon atoms and at least one of $R^1$, $R^2$, and $R^3$ is a hydrocarbyl group containing from 8 to 200 carbon atoms.

5. The fuel composition of claim 3, wherein at least three of $R^1$, $R^2$, $R^3$, and $R^4$ are methyl groups and at least one of $R^1$, $R^2$, and $R^3$ is an unsaturated linear hydrocarbyl group or a fatty amido group.

6. The fuel composition of claim 1, wherein the tertiary hydrocarbyl amine is selected from the group consisting of acylated polyamines, fatty tertiary amines, fatty acid substituted tertiary amines, alkanol tertiary amines, polyamines, and polyether tertiary amines.

7. The fuel composition of claim 1, wherein the amount of quaternary ammonium salt in the fuel ranges from about 5 to about 200 ppm by weight based on a total weight of fuel.

8. The fuel composition of claim 1, wherein the amount of quaternary ammonium salt in the fuel ranges from about 10 to about 150 ppm by weight based on a total weight of the fuel.

9. The fuel composition of claim 1, wherein the amount of quaternary ammonium salt in the fuel ranges from about 30 to about 100 ppm by weight based on a total weight of the fuel.

10. The fuel composition of claim 1, wherein said improved engine performance comprises at least about 80 percent flow remaining in an injector needle lift test when measured according to a CEC F-23-01 (XUD-9) test.

11. The fuel composition of claim 1, wherein said improved engine performance comprises engine power restoration by at least 100% when measured according to a CEC F98-08 DW10 test.

12. The fuel composition of claim 1, wherein the engine is an indirect fuel injected engine.

13. A method of improving the injector performance of a fuel injected internal combustion engine comprising operating the engine on a fuel composition comprising a major amount of fuel and from about 5 to about 200 ppm by weight based on a total weight of the fuel of a quaternary ammonium salt from the reaction of a tertiary amine and a hydrocarbyl-substituted alkyl-hydroxybenzoate of the formula

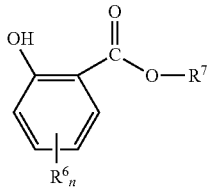

wherein $R^6$ is a hydrocarbyl group, and n is a number from 1 to 3, wherein the total carbon atoms of all of the $R^6$ groups is at least 8 up to about 200 and $R^6$ does not contain N, S or O atoms, and $R^7$ is an alkyl group containing from 1 to 4 carbon atoms, wherein the quaternary ammonium salt present in the fuel improves an injector needle lift test to at least about 80% flow remaining when measured according to a CEC F-23-01 (XUD-9) test or improve power restoration by at least 100% when measured according to a CEC F98-08 DW10 test.

14. The method of claim 13, wherein the engine comprises a direct or indirect fuel injected diesel engine.

15. The method of claim 13, wherein the quaternary ammonium salt comprises a compound of the formula

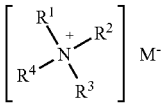

wherein each of $R^1$ , $R^2$, $R^3$, and $R^4$ is selected from hydrocarbyl groups containing from 1 to 200 carbon atoms, and $M^-$ comprises a hydrocarbyl-substituted hydroxybenzoate group derived from the hydrocarbyl-substituted alkyl-hydroxybenzoate.

16. The method of claim 15, wherein at least one and not more than three of $R^1$, $R^2$, $R^3$, and $R^4$ is a hydrocarbyl group containing from 1 to 4 carbon atoms and at least one of $R^1$, $R^2$, and $R^3$ is a hydrocarbyl group containing from 8 to 200 carbon atoms.

17. The method of claim 15, wherein at least three of $R^1$, $R^2$, $R^3$, and $R^4$ are methyl groups and at least one of $R^1$, $R^2$, and $R^3$ is an unsaturated linear hydrocarbyl group or a fatty amido group.

18. A method of operating a fuel injected internal combustion engine comprising combusting in the engine a fuel composition comprising a major amount of fuel and from about 5 to about 200 ppm by weight based on a total weight of the fuel of a quaternary ammonium salt from the reaction of a tertiary amine and a hydrocarbyl-substituted alkyl-hydroxybenzoate of the formula

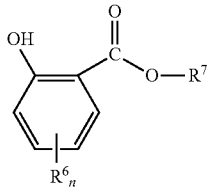

wherein $R^6$ is a hydrocarbyl group, and n is a number from 1 to 3, wherein the total carbon atoms of all of the $R^6$ groups is at least 8 up to about 200 and $R^6$ does not contain N, S or O atoms and $R^7$ is an alkyl group containing from 1 to 4 carbon atoms.

19. The method of claim 18, wherein the quaternary ammonium salt comprises a compound of the formula

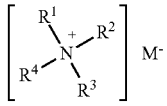

wherein each of $R^1$, $R^2$, $R^3$, and $R^4$ is selected from hydrocarbyl groups containing from 1 to 200 carbon atoms, wherein at least one and not more than three of $R^1$, $R^2$, $R^3$, and $R^4$ is a hydrocarbyl group containing from 1 to 4 carbon atoms and at least one of $R^1$, $R^2$, and $R^3$ is a hydrocarbyl group containing from 8 to 200 carbon atoms, and $M^-$ comprises a hydrocarbyl-substituted hydroxybenzoate group derived from the hydrocarbyl-substituted alkyl-hydroxybenzoate.

20. The method of claim 19, wherein at least three of $R^1$, $R^2$, $R^3$, and $R^4$ are methyl groups and at least one of $R^1$, $R^2$, $R^3$, and $R^4$ is an unsaturated linear hydrocarbyl group or fatty amido group.

21. An additive concentrate for a fuel for use in a fuel-injected internal combustion engine comprising a quaternary ammonium salt from the reaction of a tertiary amine and a hydrocarbyl-substituted alkyl-hydroxybenzoate of the formula

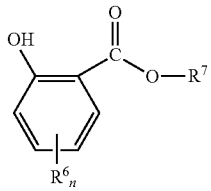

wherein $R^6$ is a hydrocarbyl group, and n is a number from 1 to 3, wherein the total carbon atoms of all of the $R^6$ groups is at least 8 up to about 200 and $R^6$ does not contain N, S or O atoms, and $R^7$ is an alkyl group containing from 1 to 4 carbon atoms, and at least one component selected from the group consisting of diluents, carrier fluids, compatibilizers, cetain improvers, corrosion inhibitors, cold flow improvers (CFPP additive), pour point depressants, solvents, demulsifiers, lubricity additives, friction modifiers, amine stabilizers, combustion improvers, dispersants, antioxidants, heat stabilizers, conductivity improvers, metal deactivators, marker dyes, organic nitrate ignition accelerators, and cyclomatic manganese tricarbonyl compounds.

22. The additive concentrate of claim 21, wherein the quaternary ammonium salt comprises a compound of the formula

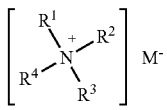

wherein each of $R^1$, $R^2$, $R^3$, and $R^4$ is selected from a hydrocarbyl group containing from 1 to 200 carbon atoms, and $M^-$ comprises a hydrocarbyl-substituted hydroxybenzoate group derived from the hydrocarbyl-substituted alkyl-hydroxybenzoate.

23. The additive concentrate of claim 22, wherein at least one and not more than three of $R^1$, $R^2$, $R^3$, and $R^4$ is a hydrocarbyl group containing from 1 to 4 carbon atoms and at least one of $R^1$, $R^2$, and $R^3$ is a hydrocarbyl group containing from 8 to 200 carbon atoms.

24. The additive concentrate of claim 22, wherein at least three of $R^1$, $R^2$, $R^3$, and $R^4$ are methyl groups and at least one of $R^1$, $R^2$, and $R^3$ is an unsaturated linear hydrocarbyl group or a fatty amido group.

25. A fuel additive compound of the formula

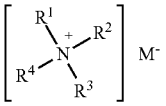

wherein each of $R^1$, $R^2$, $R^3$, and $R^4$ is selected from a hydrocarbyl group containing from 1 to 200 carbon atoms, and $M^-$ comprises hydrocarbyl-substituted hydroxybenzoate group derived from a compound of the formula

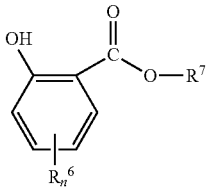

wherein $R^6$ is a hydrocarbyl group, and n is a number from 1 to 3, wherein the total carbon atoms of all of the $R^6$ groups is at least 8 up to about 200 and $R^6$ does not contain N, S or O atoms, and $R^7$ is an alkyl group containing from 1 to 4 carbon atoms.

26. The fuel additive of claim 25, wherein at least one and not more than three of $R^1$, $R^2$, $R^3$, and $R^4$ is a hydrocarbyl group containing from 1 to 4 carbon atoms and at least one of $R^1$, $R^2$, and $R^3$, is a hydrocarbyl group containing from 8 to 200 carbon atoms.

27. The fuel additive compound of claim 25, wherein at least three of $R^1$, $R^2$, $R^3$, and $R^4$ are methyl groups and at least one of $R^1$, $R^2$, and $R^3$ is an unsaturated linear hydrocarbyl group or a fatty amido group.

* * * * *